US005737943A

United States Patent [19]

Bernhardt

[11] Patent Number: 5,737,943

[45] Date of Patent: Apr. 14, 1998

[54] SEAMLESS PEDORTHIC SOCK AND METHOD OF KNITTING SAME

[75] Inventor: Frederick S. Bernhardt, Richboro, Pa.

[73] Assignee: Creative Care, Inc., Langhorne, Pa.

[21] Appl. No.: 687,695

[22] Filed: Jul. 26, 1996

[51] Int. Cl.[6] ..... D04B 1/26; A41B 11/00

[52] U.S. Cl. ..... 66/178 R; 2/239

[58] Field of Search ..... 66/60 R, 64, 170, 66/171, 174, 178 R, 178 A; 2/239, 240

[56] References Cited

U.S. PATENT DOCUMENTS

| | | | |
|---|---|---|---|
| 323,287 | 7/1885 | Appleton | 66/178 R |
| 1,228,664 | 6/1917 | Grantz . | |
| 2,004,699 | 6/1935 | Krautkopf | 66/64 |
| 2,102,369 | 12/1937 | Martel | 66/178 A X |
| 2,111,353 | 3/1938 | Berry | 66/174 |
| 2,318,772 | 5/1943 | Gluck | 66/174 |
| 2,408,440 | 10/1946 | Norman | 66/178 R |
| 3,006,169 | 10/1961 | Strunk . | |
| 3,258,940 | 7/1966 | Shima | 66/170 X |
| 3,338,071 | 8/1967 | Pons et al. . | |
| 3,429,147 | 2/1969 | Perrier . | |
| 3,451,232 | 6/1969 | Belzidsky . | |
| 3,785,173 | 1/1974 | Hanney et al. . | |
| 3,916,647 | 11/1975 | Yabuta | 66/65 |
| 3,975,929 | 8/1976 | Fregeolle . | |
| 3,983,870 | 10/1976 | Herert et al. . | |
| 4,571,960 | 2/1986 | Hursh et al. . | |
| 4,615,188 | 10/1986 | Hursh et al. . | |
| 4,840,635 | 6/1989 | Smith et al. . | |
| 5,226,194 | 7/1993 | Staley . | |
| 5,412,957 | 5/1995 | Bradberry et al. . | |
| 5,487,282 | 1/1966 | Kuhnert | 66/174 X |

FOREIGN PATENT DOCUMENTS

| | | | |
|---|---|---|---|
| 36907 | 4/1908 | France | 66/178 |
| 2454766 | 12/1990 | France | 66/178 R |

*Primary Examiner*—John J. Calvert
*Attorney, Agent, or Firm*—Howson and Howson

[57] ABSTRACT

A pedorthic sock having seamless toe area, heel pocket and leg area knitted of two or more low stretch yarns, and narrow bands of nonconstricting elastic yarn located intermediate the length of the leg area and at the top. The socks are produced by a flatbed knitting machine set up with a row of needles on each of front and back beds selectively fed with relatively low stretch yarns and an elastic yarn. The low stretch yarns form a plating knit on the inner and outer faces of the sock to produce desired functional effects.

14 Claims, 2 Drawing Sheets

SEAMLESS PEDORTHIC SOCK AND METHOD OF KNITTING SAME

BACKGROUND OF THE INVENTION

The present invention relates generally to knitted socks, and more particularly to a seamless pedorthic sock and method of knitting same as an aid in helping to prevent and alleviate painful and disabling conditions in areas of the foot and of the leg above the sock.

Prophylactic foot care is especially important to avoid potential hazards of excessive heat or cold, new shoes, constricting or mended socks, or going barefoot. Socks serve as the interface between the feet and with any surface they might come into contact to provide cushioning, warmth, absorption of moisture and, in general, a healthy environment. However, foot problems such as poor circulation, sensitive skin areas, ulcerated areas and calluses caused by friction are still common occurrences which are aggravated in various degrees by the common varieties of socks. As the skin rubs within the confines of the sock and shoe, these friction points persist to irritate and may eventually ulcerate internally. This can be debilitating with a possible loss of mobility.

Many styles of socks are traditionally knitted on small diameter circular knitting machines including tube or crew socks. The crew style contains a pocket fashioned to accommodate the heel of the foot, whereas the wearer's foot makes the heel pocket in the tube-style sock. A wide array of thin dress socks, cushioned support socks, heavyweight hunting socks, etc. are possible with different combinations of yarn, needle cylinder diameters and number of needles per cylinder. However, inherent limitations in the knitting process produce these socks with an open toe end which must be closed by a seaming operation usually performed on a sewing machine. The leg area of the sock is usually narrow and elasticized for fitting tightly around the wearer's leg to keep it from slipping down during use.

These common varieties of sock with the seamed toe area and snug fitting leg area has been the only sock generally available for protection against friction and abrasion. While generally satisfactory for normal use, it is unsuitable for persons with certain afflictions such as diabetes, edema, ischemia and obesity. The seaming in the toe area of the sock leaves a ridge either at the end or over the top of the wearer's toe. Either site may irritate the toe area. If left unattended, a skin lesion can easily become infected, and in extreme cases lead to amputation of the foot or leg. This is especially so for severely afflicted diabetics with peripheral neuropathy since the foot becomes insensitive to pain. A tightly fitting elastic top should also be avoided as any constriction may increase the possibility of edema in the upper leg area above the sock and infection.

SUMMARY OF THE INVENTION

Accordingly, it is an object of the present invention to provide a seamless pedorthic sock which has a low friction interface between the wearer's foot and any surface it might contact, and a nonconstricting top with just enough compression to keep the sock in position above the ankle without impairing vascular circulation to the foot.

Another object is to provide a pedorthic sock which is particularly suitable for therapeutic use by persons afflicted with diabetes, edema, ischemia and obesity.

Still another object is to provide a pedorthic sock having a plating of inner and outer faces of different yarns for optimizing comfort and therapeutic effects.

A further object is to provide a method for producing a seamless pedorthic sock in one continuous operation on a flatbed knitting machine.

These and other objects and novel features for the pedorthic sock according to the invention are accomplished with seamless toe, foot and leg areas knitted with a plating of two relatively low stretch yarns. A narrow band or bands of non-constricting elastic yarn, or stretchable yarn with memory, are located along the length of the leg area for keeping the sock in position above the ankle without imparting any excessive constrictions.

The sock is produced in one continuous integral operation on a programmable flatbed knitting machine with a row of needles along each of front and back beds. It begins by knitting a seamless closure of the toe area with low stretch yarns. First, the knitting gradually tapers inward on both sides of one panel from a full width of the sock for a predetermined toe length, and then gradually tapers outward on both sides of an opposed panel to the full width. Loops at opposite extremities of each course are integrally joined.

Knitting with all needles activated in both beds then continues for the full length of the foot area. Once the desired foot length is reached, the machine automatically begins knitting a heel pocket by gradually tapering both sides of one panel inward for a desired depth, and then outward to the full width of the sock to complete the heel pocket. Multiple gores, not shown, may be knitted into the toe or heel pocket for additional comfort.

Upon completing the heel pocket, the leg area of the sock is knitted with the low stretch yarns. A stretchable yarn is introduced in at least one location along its length to keep the sock in position on the wearer without creating excessive compression on the leg. A final finishing course of stretchable yarn is knitted at the top of the sock for preventing it from rolling down the leg and unravelling.

BRIEF DESCRIPTION OF THE DRAWINGS

The foregoing objects, novel features and advantages of the invention will become more apparent from the following description of the preferred embodiments when taken in conjunction with the accompanying drawings wherein.

DESCRIPTION OF THE PREFERRED EMBODIMENT

Figure 1:
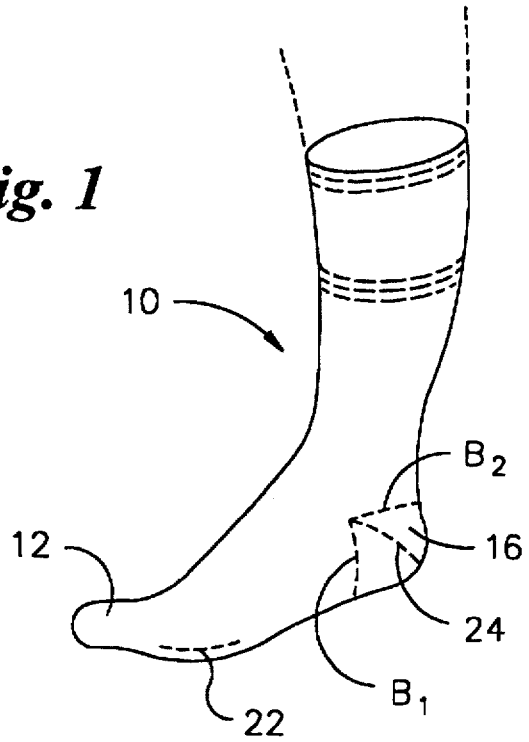
FIG. 1 represents a perspective view of a pedorthic sock according to the invention as worn on the foot.
Figure 1A:
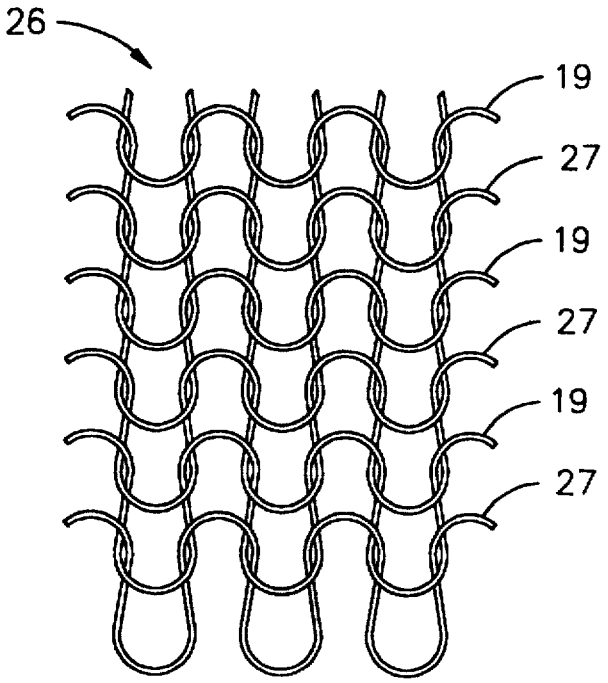
FIG. 1A represents a detailed view of a non-constricting elastic band for holding the sock in position on a leg.
Figure 2:
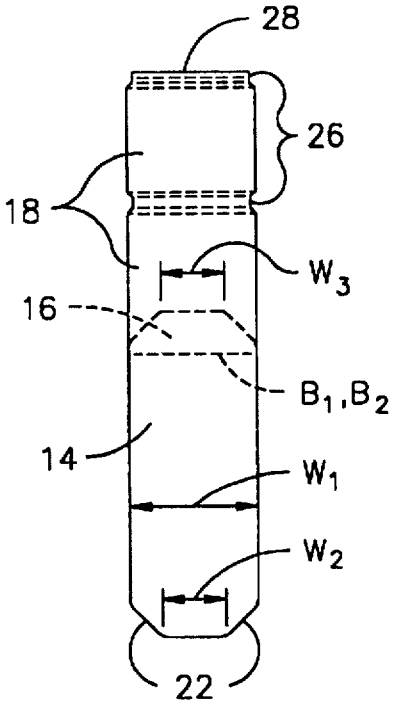
FIG. 2 is a front view of the sock with the front and back panels collapsed flatly against each other.
Figure 3:
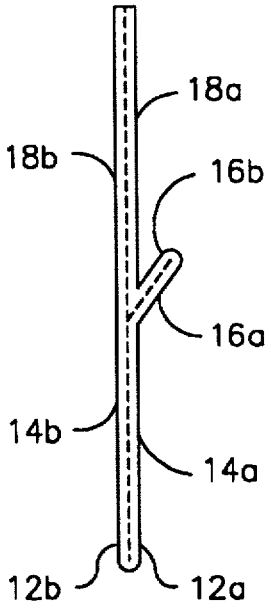
FIG. 3 is a view of the sock as viewed from the right side of FIG. 2.
Figure 4:
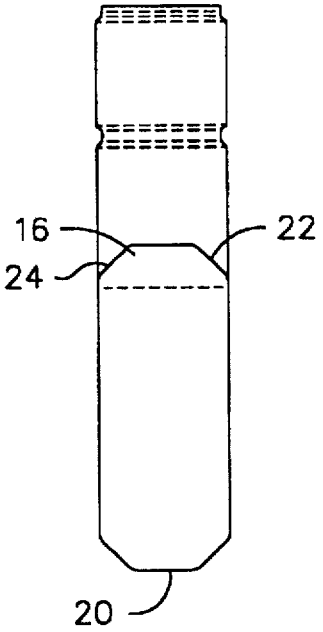
FIG. 4 is a rear view of the sock with the front and back panels collapsed flatly against each other.

Referring now to the drawings wherein like referenced characters denote like or corresponding parts throughout the several views, there is illustrated in FIG. 1 a seamless crew-style pedorthic sock 10 as worn on the foot according to a preferred embodiment of the invention. The sock is shown in, but is not limited to, a half-knee length with a heel. For instance, it may also be ankle or knee length, or tube-style without departing from the principles of the invention. A terry lining may also be knitted into the various styles. The sock comprises a toe area 12, foot area 14, heel pocket 16 and a leg area 18 knitted with a substantially low stretch yarn 19. Narrow bands 26 in leg area 18 are knitted with a substantially elastic yarn 27 to hold the sock in position on the leg, and a finishing course 28 with a substantially low stretch yarn prevents the top of the sock from rolling down and unravelling.

Sock 10 is knitted on an existing programmable flatbed knitting machine in which yarn carriers traverse back and forth across needles which are arranged along each of front and back beds. The machine is programmed to produce a fabric of plain jersey stitches having wavy horizontal loops on the inner face and vertical columns of loops on the outer face of the sock. Other stitches with or without plating may include, but not be limited to, a tuck and mock rib either singly or in combination with other stitches. The needle spacing, yarn size, yarn tension, and other variables are selected to produce a high quality fabric in the relaxed state having approximate ranges of, but not limited to, 15 to 20 wales per inch and 20 to 25 courses per inch.

A conventional sock fabric knitted with a single yarn on a flatbed machine usually forms narrow columns of close parallel wales on the outer face of the sock which contact the lining of a shoe or other footwear. The inner face usually consists of wavy crosswise rows of loops separated from each other by slight depressions which contact the foot. The texture of the inner face is inherently rough, and lacks the advantages of a sock knit with double yarn plating. By a proper choice of yarns of different textures and properties, the plated knit enhances a sock's versatility.

Figure 5:
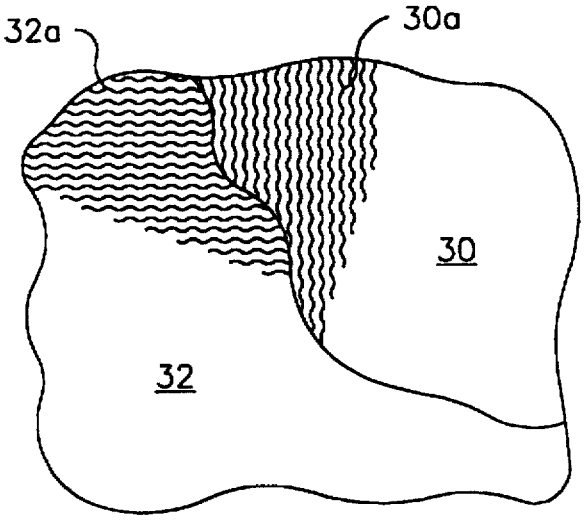
FIG. 5 is a view partially cutaway of a fragment of the sock.

The schematic cutaway of sock 10 illustrated in FIG. 5 includes a plated knit of two types of low stretch yarns in the outer and inner faces 30 and 32, respectively. Longitudinal or vertical courses 30*a* of one yarn have closely parallel wales exposed on inner face 30 and transverse or horizontal courses 32*a* of the other yarn exposed on inner face 32. A combination, for instance, of a smooth yarn, dominant on the inner face 32, reduces friction at the interface of the foot and the sock, and a rougher yarn dominant on the outside face 30 increases the friction at the interface of the sock and the shoe. Similarly, a tacky yarn surface against the foot and a smooth surface against the shoe, or a soft yarn against the foot coupled with a yarn that dissipates moisture on the outside, may satisfy requisite performance characteristics. Other combinations of yarns are possible in order to alleviate areas of irritation while walking, especially those areas with calluses. Other combinations of yarn, of course, are possible depending on the specific malady. A suitable method for plating the sock is disclosed in U.S. Pat. No. 3,451,232.

The knitting process starts near the toe of sock 10 with the yarn carriers feeding the low stretch yarns 27 to opposed needles of the front and back beds to knit a seamless course of stitches along the full breadth $W_1$ of the sock in the toe area 12 with loops at the course extremities interconnected. All of the back bed needles are then deactivated while the front bed needles continue knitting but are gradually deactivated from the opposite ends of each course to form inwardly tapered sides of a back panel 12*a* of toe area 12 with a tip 20 of breadth $W_2$. The needles of the front row which were deactivated are then reactivated in reverse order to form outwardly tapered sides of a front panel 12*b* of toe area 12 until the full width $W_1$ is reached. Loops 22 at the opposite extremities of each course of panels 12*a* and 12*b* are joined to form a seamless toe area.

The knitting process with the needles in both beds then continues with back and front panels 14*a* and 14*b*, joined in like manner to form foot area 14 up to a course located at the beginning of heel pocket 16 along the back panel 14*a* as illustrated by dotted line $B_1$.

Heel pocket 16 is then formed by inactivating all of the back bed needles while knitting continues on the front bed needles with needles from opposite ends of the course being gradually deactivated to taper a bottom section 16*a* of heel pocket 16 inward to a suitable breadth $W_3$. The same needles deactivated in the front bed are then reactivated to gradually taper a top section 16*b* outward to the full sock width $W_1$ at a course, shown by dotted line $B_2$, across the back panel 18*a* of sock 10. The opposite extremities 24 of the courses of sections 16*a* and 16*b* are integrally joined by seamless loops to form a pocket.

All the needles in both beds then continue knitting the front and back panels 18*a* and 18*b* with low stretch yarns 19 to form leg area 18. The knitting process continues to an intermediate location along the length of leg area 18 where the yarn carriers feed courses of an elastic yarn 19 between courses of the low stretch yarns 19 to form a first narrow non-constricting elastic band 26. The process then returns to knitting with only the low stretch yarns and terminates with a second narrow elastic band 26 and at least one finishing course 28 at the top of the sock.

Of course it is understood the described process can also be accomplished by reversing the needle activation on the front and back beds of the machine. For example, the needles on the front bed could be deactivated while the needles on the back bed are activated to form the front panel of toe area 12 first.

Various types and sizes of yarns are contemplated depending on the individual requirements of the wearer such as softness, moisture absorptivity, elasticity and smoothness. Suitable low stretch yarns 19 include, but are not limited to, single or multiple plies of acrylic, rayon, wool, cotton, polyester, silk and teflon fibers or combinations thereof, in various sizes. Suitable elastic yarns 27 include, but are not limited to, stretchable fibers with restorative memory such as texturized nylon or polyester, or an elastomeric core made of spandex or rubber and covered with any of the above-stated fibers Some of the many advantages and novel features of the invention should now be readily apparent. For example, a seamless pedorthic sock is provided having a low friction interface between the wearer's foot and with any surface it might contact. The sock is prevented from sliding downward on the leg by non-constricting elastic bands which minimizes the reduction of vascular circulation to the foot. The sock may include plating to provide inner and outer faces of various physical properties for optimizing the therapeutic effect. The sock is particularly suitable for therapeutic use by persons afflicted with diabetes, edema, ischemia and obesity. A unique method is disclosed which enables the sock to be produced in one continuous operation on a programmable flatbed knitting machine.

It will be understood, of course, that various changes in the details, materials, steps and arrangement of part, which have been described and illustrated in order to explain the nature of the invention, may be made by those skilled in the art without departing from the scope of the invention as expressed in the appended claims.

I claim:

1. A seamless sock, completely finished on a flatbed knitting machine, comprising:

knitted elongate first and second panels of courses of low stretch yarn collapsible flatly against each other having opposite course extremities interconnected to form seamless upper and lower portions for respectively receiving a foot and a leg of a wearer, said lower portion including tapered sides with opposite courses of said panels interconnected to form a seamless closure for bearing against toes of the foot, said upper portion including at least one non-constricting narrow band of courses of substantially elastic yarn between courses of said low stretch yarn for applying sufficient compression to keep said upper portion in a position around the leg, and said upper portion terminating with a finishing course to prevent the top of the sock from rolling down and unraveling.

2. A seamless sock according to claim 1 wherein said panels comprise a plating of a substantially smooth and low stretch yarn with loops facing predominantly inside the sock for reducing friction against the foot, and a substantially absorbent yarn with loops facing predominantly outside the sock for dissipating perspiration.

3. A seamless sock according to claim 1 wherein said panels comprise a plating of a substantially tacky and low-stretch yarn with loops facing predominantly inside the sock for adhering to the foot, and a substantially smooth and low stretch yarn with loops facing predominantly outside the sock for reducing friction against outer footwear against the outer footwear.

4. A seamless sock according to claim 1 further comprising:

knitted third and fourth panels collapsible flatly against each other having ends of opposite courses interconnected with respective courses in said second panel intermediate the ends thereof, and having opposite course extremities interconnected to form a seamless tapered pocket for receiving a heel surface of the foot.

5. A seamless sock according to claim 4 wherein said panels have plating of a substantially smooth and low stretch yarn with loops facing predominantly inside the sock for reducing friction against the foot, and a substantially absorbent yarn with loops facing predominantly outside the sock for dissipating perspiration.

6. A seamless sock according to claim 4 wherein said panels comprise a plating of a substantially tacky and low stretch yarn with loops facing predominantly inside the sock for adhering to the foot, and a substantially smooth and low stretch yarn with loops facing predominantly outside the sock for reducing friction against outer footwear against the outer footwear.

7. A seamless pedorthic sock, completely finished on a flatbed knitting machine, for covering a wearer's foot and leg comprising, in combination:

knitted elongate first and second panels of courses of low stretch yarn collapsible flatly against each other having opposite course extremities interconnected to form seamless upper and lower portions for inserting the foot and leg, respectively, said lower portion having seamless tapered sides with opposite courses of said panels interconnected to form a seamless closure for bearing against the wearer's toes, and said upper portion including a plurality of non-constricting narrow elastic bands at spaced apart intervals of a course of substantially elastic yarn between courses of said low stretch yarn for applying sufficient compression around the leg to keep the sock from slipping down and said upper portion terminating with a finishing course to prevent the top of the sock from rolling down and unraveling; and knitted third and fourth panels collapsible flatly against each other having ends of opposite courses interconnected with respective courses in said second panel intermediate the ends thereof, and having opposite course extremities thereof interconnected to form a seamless tapered pocket for bearing against a heel surface of the foot.

8. A seamless pedorthic sock according to claim 7 wherein transverse portions of inner facing loops of one kind of said low stretch yarn is predominantly exposed to the foot and leg, and longitudinal portions of outer facing loops of another kind of said low stretch yarn is predominantly exposed to an external surface.

9. A method of knitting a completely finished seamless pedorthic sock on a flatbed knitting machine set up with at least one set of needles along each of front and back beds, comprising the steps of:

knitting a course of a first low stretch yarn with both sets of needles activated across a predetermined full width of the sock;

knitting courses of the first low stretch yarn with one bed of needles deactivated while the other bed of needles at respective course ends are gradually deactivated from the full width to a predetermined toe width and gradually reactivating the needles in the other bed to the full width with the course extremities each interconnected to form a tapered seamless toe area;

knitting courses of the first low stretch yarn with both sets of needles activated for the full width of the sock with course extremities interconnected to form seamless foot and leg areas;

knitting courses of a substantially elastic yarn between courses of the first low stretch yarn with the course extremities interconnected to form at least one narrow non-constricting elastic band intermediate the length of the leg area; and knitting at least one finishing course of the first low stretch yarn.

10. A method according to claim 9 further comprising:

plating said courses of the first low stretch yarn with a second low stretch yarn of different physical properties to form respectively inner and outer facing loops of the sock.

11. A method of knitting a completely finished seamless pedorthic sock on a flatbed knitting machine set up with rows of needles along each of front and back beds and selectively fed with a first yarn substantially inelastic and a second substantially elastic yarn, comprising the sequential steps of:

knitting a course of the first yarn with both rows of needles activated across a predetermined width of the sock;

knitting courses of the first yarn with needles of one of the rows deactivated, with needles at each end of the other row gradually deactivated and reactivated in reverse order to the predetermined width, and with the extremities of the courses interconnected to form a tapered seamless toe area;

knitting courses of the first yarn with needles of both of the rows activated, and with the course extremities interconnected to form a seamless foot area for the width of the sock;

knitting courses of the first yarn with needles of one of the rows deactivated, with needles of the other row gradually deactivated at opposite end and reactivated in reverse order and with the course extremities interconnected to form a tapered seamless heel pocket;

knitting courses of the first yarn with needles of both of the rows activated to form a first leg area the width of the sock above the heel pocket;

knitting courses of the second yarn between courses of the first yarn with the needles of both of the rows, and with course extremities interconnected to form a first non-constricting narrow elastic band above the first leg area;

knitting courses of the second yarn between courses of the first yarn with the needles of both of the rows to form a second leg area the width of the sock above the first elastic band;

knitting courses of the elastic yarn between courses of the first yarn with needles of both of the rows activated and the course extremities interconnected to form a second non-constricting narrow elastic band above the second leg area; and knitting at least one finishing course of the first yarn above the second elastic band.

12. A method of knitting a completely finished seamless sock on a flatbed knitting machine having front and back beds of needles, comprising the steps of:

knitting, with needles of both beds, a first course of a first low stretch yarn across a first width of the sock;

knitting, with needles of one bed, second courses of the first low stretch yarn forming an inward taper from the first width to a second width and then an outward taper from the second width to the first width to form a toe area;

knitting, with needles of both beds, third courses of the first low stretch yarn at the first width to form foot and leg areas;

knitting, with needles of both beds, fourth courses of an elastic yarn at the first width between courses of the third course to form a non-constricting band around the leg area; and knitting a finishing course of the first low stretch yarn.

13. A method according to claim 12 further comprising the step of:

knitting, with needles of one bed, fifth courses of the first low stretch yarn forming an inward taper from the second courses to a selected width, and then an outward taper to the first width to form a heel pocket.

14. A method according to claim 12 further comprising the step of:

plating said courses of the first low stretch yarn with a second low stretch yarn to form respectively inner and outer facing loops of the sock, said first and second yarns having low friction and high perspiration absorbency, respectively.

* * * * *

UNITED STATES PATENT AND TRADEMARK OFFICE

CERTIFICATE OF CORRECTION

PATENT NO. : 5,737,943

DATED : April 14, 1998

INVENTOR(S) : Frederick S. Bernhardt

It is certified that error appears in the above-identified patent and that said Letters Patent is hereby corrected as shown below:

Column 3, line 52, "27" should be changed to --19--;

Column 4, line 19, "19" should be changed to --27--.

Signed and Sealed this

Ninth Day of June, 1998

*Attest:*

Bruce Lehman

BRUCE LEHMAN

*Attesting Officer*

*Commissioner of Patents and Trademarks*